US010814367B2

(12) United States Patent
Brummayer et al.

(10) Patent No.: US 10,814,367 B2
(45) Date of Patent: Oct. 27, 2020

(54) METHOD FOR THE HOMOGENEOUS NON-CONTACT TEMPERATURE CONTROL OF NON-ENDLESS SURFACES WHICH ARE TO BE TEMPERATURE-CONTROLLED, AND DEVICE THEREFOR

(71) Applicant: voestalpine Stahl GmbH, Linz (AT)

(72) Inventors: Markus Brummayer, Aschach (AT); Kurt Etzelsdorfer, Leonding (AT)

(73) Assignee: voestalpine Stahl GmbH, Linz (AT)

( * ) Notice: Subject to any disclaimer, the term of this patent is extended or adjusted under 35 U.S.C. 154(b) by 101 days.

(21) Appl. No.: 15/577,289

(22) PCT Filed: May 18, 2016

(86) PCT No.: PCT/EP2016/061102
§ 371 (c)(1),
(2) Date: Nov. 27, 2017

(87) PCT Pub. No.: WO2016/192994
PCT Pub. Date: Dec. 8, 2016

(65) Prior Publication Data

US 2018/0155803 A1 Jun. 7, 2018

(30) Foreign Application Priority Data

May 29, 2015 (DE) ..... 10 2015 108 514
Aug. 7, 2015 (DE) ..... 10 2015 113 056

(51) Int. Cl.
*C22C 38/02* (2006.01)
*B21B 45/02* (2006.01)
(Continued)

(52) U.S. Cl.
CPC ..... *B21B 45/0218* (2013.01); *B21B 45/0233* (2013.01); *C21D 1/613* (2013.01);
(Continued)

(58) Field of Classification Search
CPC ..... C21D 9/0062
See application file for complete search history.

(56) References Cited

U.S. PATENT DOCUMENTS 4,150,963 A * 4/1979 Imler ..... C03B 27/052 65/104
5,871,686 A 2/1999 Nivoche
(Continued)

FOREIGN PATENT DOCUMENTS

DE 698-33-424 T2 10/2006
DE 11-2010-000-702 T5 9/2012
(Continued)

OTHER PUBLICATIONS

International Search Report in International Application No. PCT/EP2016/061102, filed May 18, 2016, along with its English Translation.

*Primary Examiner* — Scott R Kastler
(74) *Attorney, Agent, or Firm* — Saliwanchik, Lloyd & Eisenschenk

(57) ABSTRACT

The present invention relates to an apparatus for tempering hot articles, in particular an apparatus for homogeneous, contactless tempering of primarily non-endless surfaces that are to be tempered; the tempering apparatus has at least one tempering blade or a tempering cylinder; the tempering blade or tempering cylinder is embodied as hollow and has a tempering blade nozzle edge or a plurality of tempering cylinders arranged in a row; in the nozzle edge at least one nozzle is provided, which is aimed at an article to be tempered; and at least seven tempering blades are arranged in such a way that the flow pattern on the surface to be tempered forms a honeycomb-like structure; and to a method therefor.

9 Claims, 10 Drawing Sheets

(51) Int. Cl.

| | |
|---|---|
| ***C21D 1/613*** | (2006.01) |
| ***C21D 1/667*** | (2006.01) |
| ***C21D 1/62*** | (2006.01) |
| ***C21D 9/00*** | (2006.01) |
| ***C21D 1/673*** | (2006.01) |
| ***C21D 6/00*** | (2006.01) |
| ***C21D 9/46*** | (2006.01) |
| ***C22C 38/00*** | (2006.01) |
| ***C22C 38/04*** | (2006.01) |
| ***C22C 38/06*** | (2006.01) |
| ***C22C 38/28*** | (2006.01) |
| ***C22C 38/32*** | (2006.01) |
| ***C23C 2/28*** | (2006.01) |
| ***F27D 7/02*** | (2006.01) |
| *C23C 2/06* | (2006.01) |
| *C23C 2/40* | (2006.01) |
| *F27D 9/00* | (2006.01) |
| *C21D 8/02* | (2006.01) |

(52) U.S. Cl.

CPC ..... *C21D 1/62* (2013.01); *C21D 1/667* (2013.01); *C21D 1/673* (2013.01); *C21D 6/002* (2013.01); *C21D 6/005* (2013.01); *C21D 6/008* (2013.01); *C21D 9/0062* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/28* (2013.01); *C22C 38/32* (2013.01); *C23C 2/28* (2013.01); *F27D 7/02* (2013.01); *C21D 8/0247* (2013.01); *C21D 2211/001* (2013.01); *C21D 2211/008* (2013.01); *C23C 2/06* (2013.01); *C23C 2/40* (2013.01); *F27D 2009/007* (2013.01)

(56) References Cited

U.S. PATENT DOCUMENTS

| | | | |
|---|---|---|---|
| 2003/0034593 | A1 | 2/2003 | Lee |
| 2011/0018178 | A1 | 1/2011 | Muller et al. |
| 2014/0117595 | A1 | 5/2014 | Serizawa |
| 2015/0239027 | A1 | 8/2015 | Alken et al. |
| 2018/0155803 | A1* | 6/2018 | Brummayer ..... C21D 9/0062 |

FOREIGN PATENT DOCUMENTS

| | | | |
|---|---|---|---|
| DE | 10-2011-053-941 | A1 | 3/2013 |
| KR | 10-0441365 | B1 | 9/2004 |
| KR | 10-2015-0016411 | A | 2/2015 |
| WO | WO-2014/006008 | A1 | 1/2014 |

* cited by examiner

METHOD FOR THE HOMOGENEOUS NON-CONTACT TEMPERATURE CONTROL OF NON-ENDLESS SURFACES WHICH ARE TO BE TEMPERATURE-CONTROLLED, AND DEVICE THEREFOR

CROSS-REFERENCE TO RELATED APPLICATIONS

This application is the U.S. national stage application of International Patent Application No. PCT/EP2016/061102, filed May 18, 2016, which claims priority to German Application Nos. 10 2015 108 514.3, filed May 29, 2015 and 10 2015 113 056.4, filed Aug. 7, 2015, the disclosures of each of which are incorporated herein by reference in their entirety.

The invention relates to a method for homogeneous, contactless tempering of primarily non-endless surfaces to be tempered and to an apparatus therefor.

In the technical field, tempering processes are needed in many areas, for example when it is necessary to cool or heat flat plates, but also when it is necessary to cool or heat glass surfaces, for example in glass production, or to cool or heat processor units and the like.

Prior cooling systems are either very expensive or are kept quite simple, e.g. by blowing air or other fluids such as water or oil; this entails the disadvantage that unfavorable, uncontrolled flow conditions always occur on the surface, which then become a problem when a particularly defined tempering is required.

In the prior art, it must be largely assumed that disadvantageous flow conditions, so-called cross flow, exist on the flat surface that is to be tempered and this causes heterogeneous surface temperatures. This is particularly disadvantageous if homogeneous temperatures are required in the region of the surface in order to achieve homogeneous material properties. In particular, non-homogeneous surface temperatures also cause warpage.

Conventional cooling methods do not permit a controlled achievement of a predetermined target temperature, nor do they make it possible to systematically set virtually any tempering rate up to a maximum achievable tempering rate.

There are particular difficulties if different material thicknesses are present on a tempering surface, which are to be cooled to homogeneous temperature conditions.

In the same way, heating is also associated with problems in the prior art.

Particularly when heating plates and even more particularly when heating metal plates, e.g. for purposes of hardening or forming, these plates are acted on either with burners, electrical electric resistance heaters, or a direct plate heating.

All of these types of heating involve the disadvantage that they are very complicated or, particularly with different thicknesses, lead to different heating results. They do not permit a small, area by area control of the heating.

It is also known in the prior art to first preheat flat metal plates, in particular steel sheet blanks, with a wide variety of methods and to then carry out a heating—over the entire area or only in some areas—to a temperature that then permits a hardening to be carried out.

Even with heating methods, nonhomogeneous surface temperatures can result in warpage.

The object of the invention is to achieve reproducible, systematic, homogeneous, contactless tempering of primarily non-endless hot surfaces to a defined surface temperature within a few seconds.

The object is attained with an apparatus as described herein.

Advantageous modifications are disclosed in the dependent claims that are dependent thereon.

Another object of the invention is to produce a method for reproducible, systematic, homogeneous contactless tempering of primarily non-endless hot surfaces to a defined surface temperature within a few seconds.

The object is attained with a method as described herein.

Advantageous modifications are disclosed in the dependent claims that are dependent thereon.

According to the invention, it should be possible at temperatures of 20 to 900° C. to ensure a tempering, i.e. a cooling or heating, that permits a maximum of a 30° C. temperature deviation within a square meter. The cooling mediums used are air gases and mixed gases, but can also be water or other fluids. The heating mediums used are preferably hot gases.

The invention should make it possible, for a low investment cost and with low operating costs, to achieve high system availability, high flexibility, and simple integration into existing production processes.

According to the invention, this is successfully achieved in that the surface to be tempered can be moved by means of robots or linear drives in the X, Y, or Z plane, it being possible to preset any movement trajectories and speeds of the surface to be cooled. In this case, the oscillation is preferably around a rest position in the X and Y planes. It is optionally possible for there to be oscillation in the Z plane (i.e. in the vertical direction).

It is also easily possible for there to be cooling on one or both sides.

The tempering units according to the invention are comprised of nozzles, which are spaced a certain distance apart from one another. The geometry of the nozzles, i.e. of the outlet opening, from simple cylindrical geometries through complex geometrically defined embodiments. The tempering unit in this case is embodied so that the medium flowing away from the hot plate finds enough room and as a result, no cross flow is produced on the surface to be cooled. The spaces between the nozzles and/or nozzle rows can be acted on with an additional cross flow in order to increase the tempering rate and thus suck up, so to speak, the tempering medium that is flowing away from the hot plate. This cross flow, however, should not interfere with the tempering medium flowing from the nozzle to the plate, i.e. the free flow.

According to the invention, the preferred flow pattern on the surface to be cooled should have a honeycomb-like structure.

In this case, the cooling preferably takes place by means of at least one cooling blade; the cooling blade is a plate-like or cylindrical element, which can also taper from a base toward an outlet strip; and at least one nozzle is mounted in the outlet strip. In this case, the blade is embodied as hollow so that the nozzle can be supplied with a tempering fluid from the hollow blade. The nozzle(s) can be spaced apart from one another with wedge-like elements; the wedge-like elements can also narrow the space for the flowing fluid in the direction toward the nozzle.

In particular, this produces a twisting of the emerging jet of fluid.

Preferably, a plurality of blades is provided, situated next to one another, with the blades being offset from one another.

The offset arrangement likewise produces a tempering with points that are offset from one another, with the points blending into one another to produce homogeneous cooling and the emerging fluid is sucked up in the region between two blades and conveyed away.

In this case, the element to be tempered, e.g. a plate to be tempered, is preferably moved so that the movement of the plate one the one hand and the offset arrangement of the nozzles on the other ensures that the tempering fluid flows across all of the regions of the plate so that a homogeneous tempering is achieved.

The invention will be explained by way of example based on the drawings. In the drawings.

Figure 12:
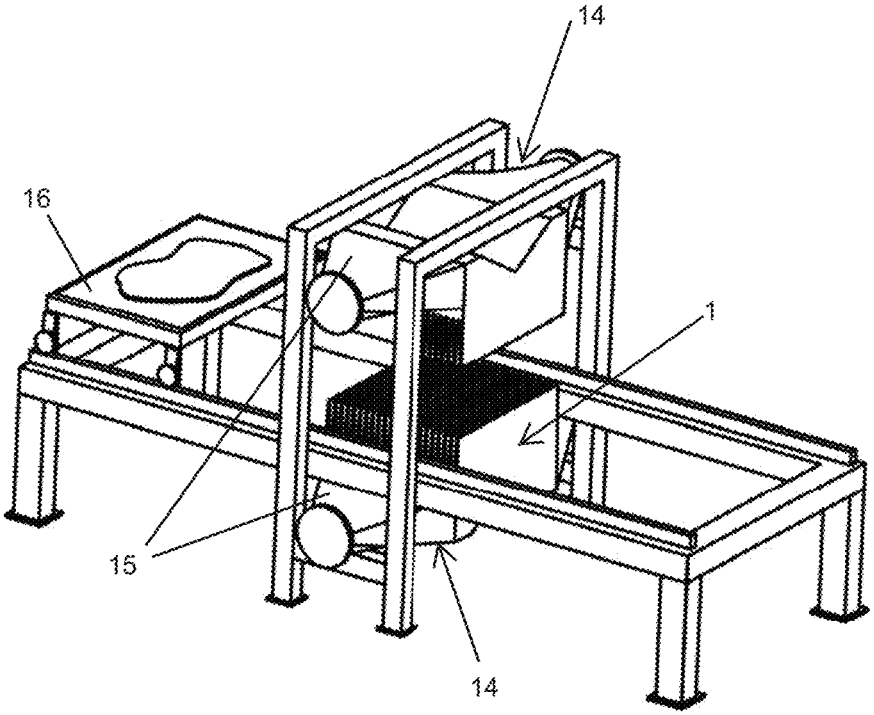

FIG. 12 schematically depicts the arrangement of two opposing cooling boxes composed of a plurality of tempering blades according to the invention arranged offset from one another and a moving carriage for taking an article to be cooled and conveying it through.

Figure 13:
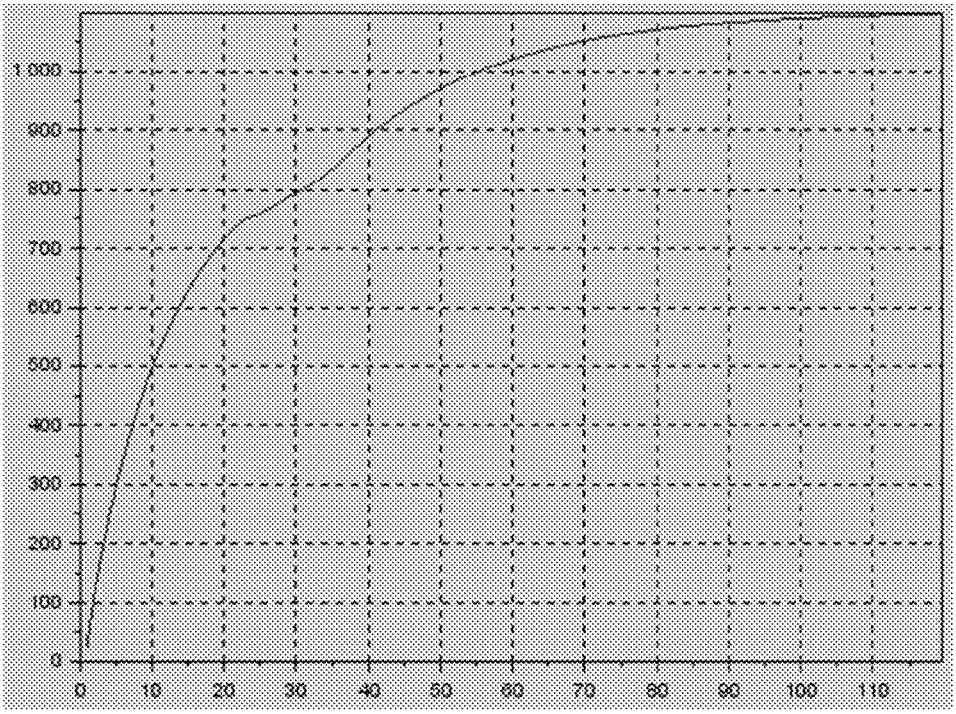

FIG. 13 shows a heating curve achieved with an apparatus according to the invention in a flat sheet metal blank, showing the sheet temperature.

One possible embodiment will be described below.

The tempering apparatus 1 according to the invention has at least one tempering blade 2. The tempering blade 2 is embodied in the form of an elongated flap and has a tempering blade base 3, two tempering blade broad sides 4 extending away from the tempering blade base, two tempering blade narrow sides 5 that connect the tempering blade broad sides, and a free nozzle edge 6.

The tempering blade 2 is embodied as hollow with a tempering blade cavity 7; the cavity is enclosed by the tempering blade broad sides 4, the tempering blade narrow sides 5, and the nozzle edge 6; the tempering blade is open at the base 3. With the tempering blade base 3, the tempering blade is inserted into a tempering blade frame 8; and the tempering blade frame 8 can be placed onto a hollow fluid supply box.

The region of the nozzle edge 6 is provided with a plurality of nozzles or openings, which reach into the cavity 7 and thus permit fluid to flow out of the cavity to the outside through the nozzles 10.

From the nozzles, nozzle conduits 11 extend into the cavity 7, spatially separating the nozzles from one another, at least in the region of the nozzle edge 6. The nozzle conduits in this case are preferably embodied as wedge-shaped so that the nozzle conduits or nozzles are separated from one another by wedge-shaped struts 12. Preferably, the nozzle conduits are embodied so they widen out in the direction toward the cavity 7 so that an incoming fluid is accelerated by the narrowing of the nozzle conduits.

The tempering blade broad sides 4 can be embodied as converging from the tempering blade base 3 toward the nozzle edge 6 so that the cavity narrows in the direction toward the nozzle edge 6.

In addition, the tempering blade narrow sides 5 can be embodied as converging or diverging.

Preferably, at least two tempering blades 2 are provided, which are arranged parallel to each other in relation to the broad sides; with regard to the spacing of the nozzles 10, the tempering blades 2 are offset from one another by a half nozzle distance.

It is also possible for there to be more than two tempering blades 2.

With regard to the span of the nozzle edge, the nozzles 10 can likewise be embodied as longitudinally flush with the nozzle edge; the nozzles, however, can also be embodied as round, oval and aligned with the nozzle edge or oval and transverse to the nozzle edge, hexagonal, octagonal, or polygonal.

Particularly if the nozzles, with regard to the longitudinal span of the nozzle edge, are likewise embodied as oblong, particularly in the form of an oblong oval or oblong polygon, this causes a twisting of an emerging jet of fluid (FIGS. 10 & 11); an offset arrangement by half a nozzle spacing distance yields a tempering pattern on a plate-like body (FIG. 10), which is correspondingly offset.

Figure 11:
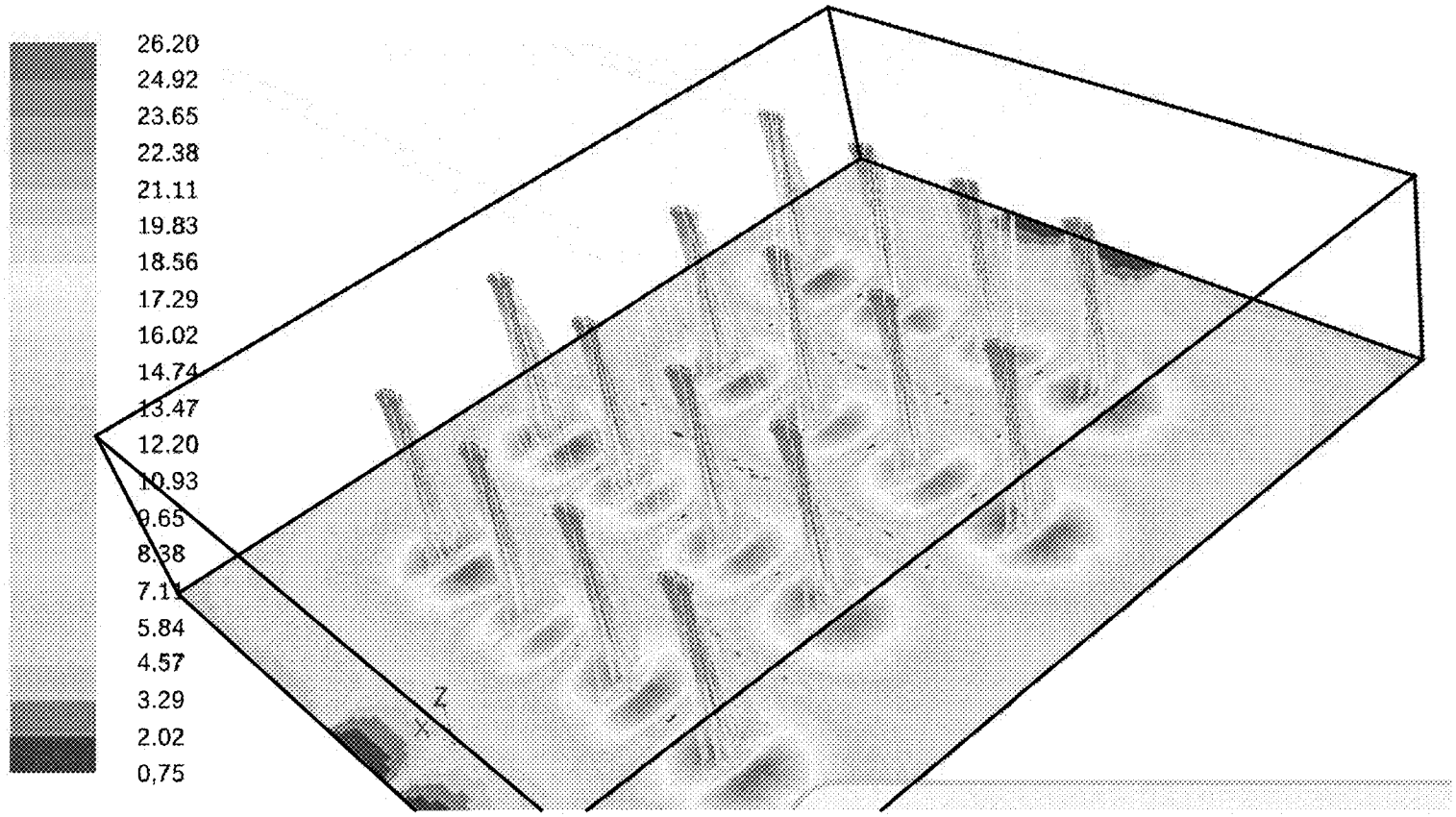
FIG. 11 is a view of the arrangement according to FIG. 10, showing the speed distribution.

The corresponding speed profile also produces a corresponding distribution (FIG. 11).

According to the invention, it has turned out that fluid flowing out of the nozzles 10 does in fact strike the surface of a body to be tempered (FIGS. 10 & 11), but it clearly flows away, plunging between the at least two blades of the tempering apparatus 1 so that the tempering flow at the surface of a body to be tempered is not interrupted.

Preferably the following conditions are present:

hydraulic diameter of nozzle=DH, where DH=4×A/U distance of nozzle from body=H distance between two tempering blades/cooling cylinders=S length of nozzle=L

L>=6×DH

H<=6×DH, esp. 4 to 6×DH

S<=6×DH, esp. 4 to 6×DH (staggered array)

oscillation=half of the spacing distance between two tempering blades in X, Y (poss. Z)

For example, a tempering apparatus (FIG. 12) has two arrangements of tempering blades 2 in a tempering blade frame 8; the tempering blade frames 8 are embodied with corresponding fluid supplies 14 and particularly on the side oriented away from the tempering blades 2, are provided with a fluid box (15) that contains pressurized fluid, in particular by means of a supply of pressurized fluid.

If the tempering apparatus is supposed to cool a body, then a cooling medium is used, which is preferably supplied to a tempering blade; with a plurality of tempering blades, the cooling medium is preferably supplied centrally to the fluid supply box and from there, is distributed to the tempering blades.

If the tempering apparatus is used for heating a corresponding plate or a corresponding article, then it is possible for the heating to be carried out by means of gaseous mediums.

These gaseous mediums can be correspondingly heated to a target temperature outside the tempering apparatus. Such a heating is possible, for example, with conventional hot-blast stoves.

It is also possible for the heating of the corresponding fluids to be carried out in the fluid supply box. In this case, the fluids can be heated by means of direct or indirect heating in particular by means of burners, radiant tubes, electric resistance heaters, and the like.

It is also possible to make direct use of the hot exhaust gases produced by burners.

In these cases, it is also possible to accelerate the corresponding gases beforehand or subsequently or to pressurize them in order to ensure a sufficient outflow from the nozzles.

In a first exemplary embodiment, a sheet blank is heated by means of purely convective heat by means of a hot gas at a temperature of 1100° C. and tempered with a heat transfer coefficient of 200 W/m^2/K.

The heating curve (temperature in ° C. plotted over time in s) of this purely convective heating is shown in FIG. 13. It is very clear that a heating to a temperature of greater than Ac3, i.e. the austenitization temperature, which is 900° C. with a manganese/boron steel, for example, occurs rapidly and this method is therefore also very suitable for hot forming, for example.

Naturally, it is not necessary to use a flat sheet blank for this purpose and instead, it is also possible to heat an appropriately preformed component.

In a second exemplary embodiment, only a subregion of the sheet blank is tempered, i.e. heated from room temperature (approx. 20° C.) to a temperature above Ac3 (approx. 900° C.)

The partial austenitization advantageously hardens only these regions whereas other regions of the sheet blank remain soft after a hot forming step (not described in greater detail here).

The setting of this zone—depending on the embodiment of the nozzle blades—can be adjusted quite exactly and in this example, can even be used for an exact tempering of regions within the sheet blank from an area of at least 60 mm×60 mm down to a few millimeters. If edge regions of the sheet blank are affected, then with a corresponding movement through the nozzle field, they can be tempered even more exactly if parts of the sheet blank do not travel through the nozzle field.

A third exemplary embodiment reveals that the sheet blank can also be preheated—for example by means of a roller hearth furnace or other storage furnace.

After this, the tempering of the sheet blank, which is carried out all over or only in some areas, to a temperature greater than Ac3 is carried out by means of gas heating.

Gas inlet temperature: 1800° C.

Starting temperature for sheet blank: 500° C.

Final temperature of sheet blank: 1200° C.

Duration of time from 500° C. to 1200° C.: approx. 30 sec

Duration of time from 500° C. to 900° C.: approx. 16 sec

Setup: dual-sided heating

In addition, a moving device 16 is provided; the moving device is embodied so that a body to be tempered can be conveyed between the opposing tempering blade arrangements in such a way that a cooling action can be exerted on both sides of the body to be tempered.

The distances of the nozzle edges 6 from the body to be tempered in this case are, for example, 5 to 250 mm.

Figure 1:
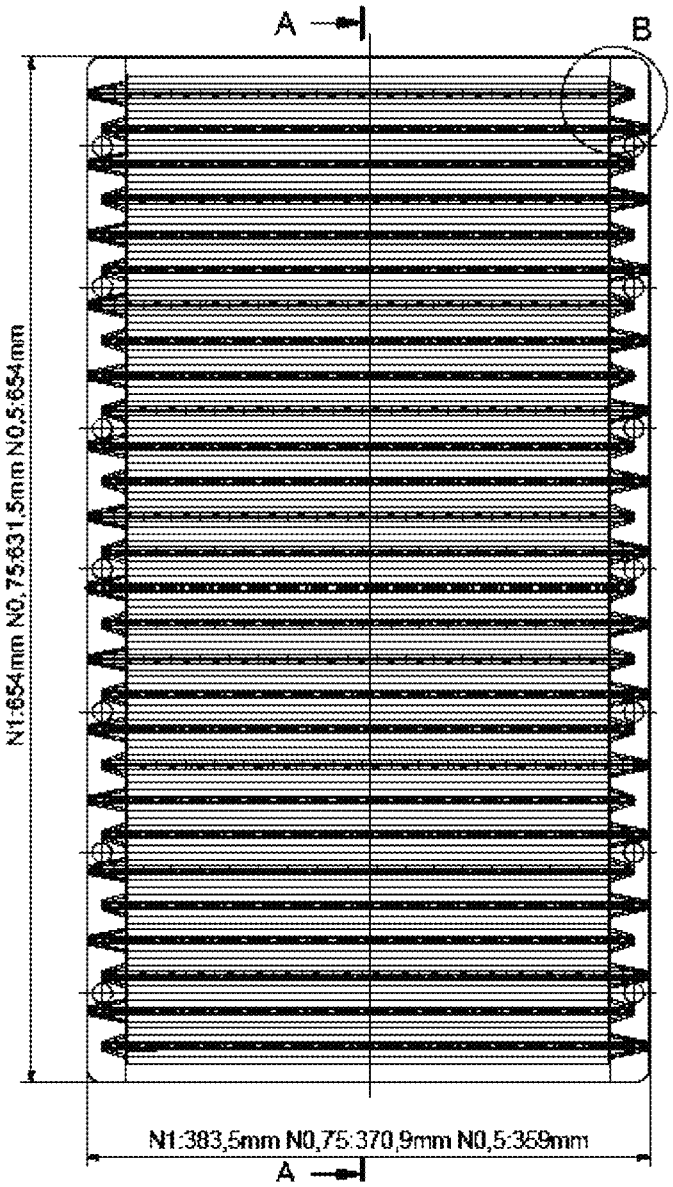
FIG. 1 shows a top view of a plurality of tempering blades arranged parallel to one another.
Figure 2:
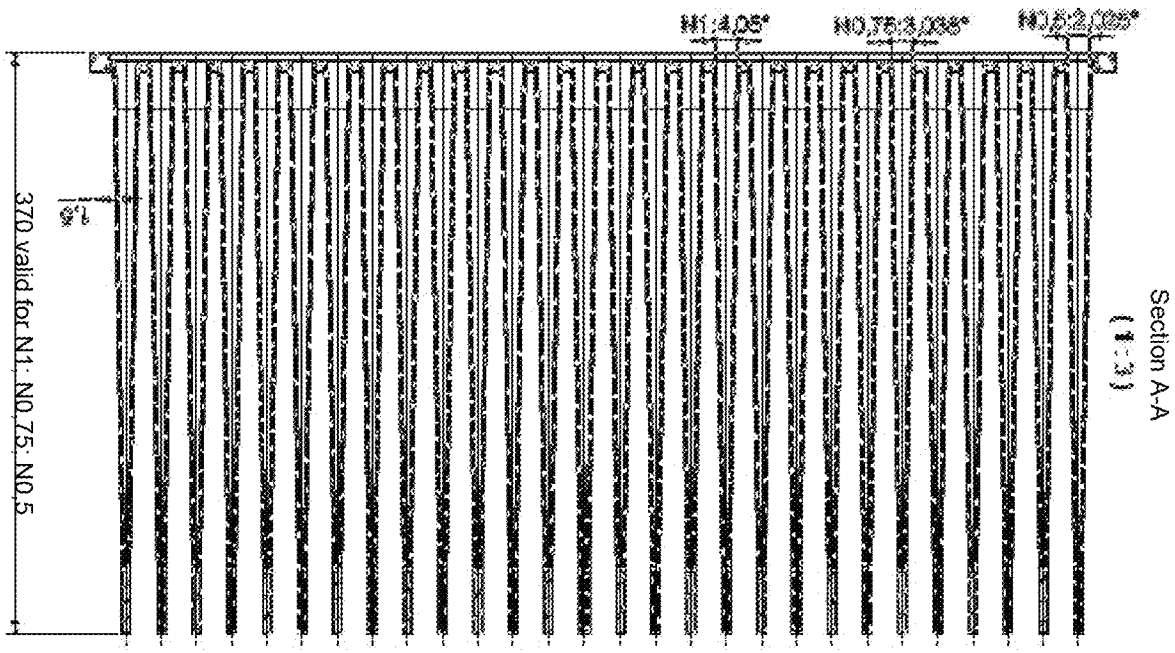
FIG. 2 shows the arrangement of tempering blades according to the section A-A in FIG. 1.
Figure 3:
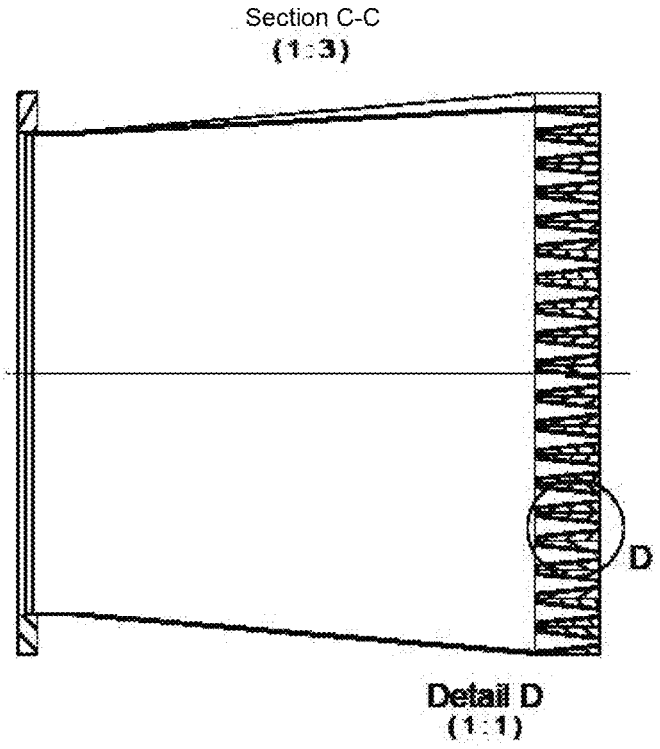
FIG. 3 shows a longitudinal section through a tempering blade according to the section line C-C in FIG. 2.
Figure 4:
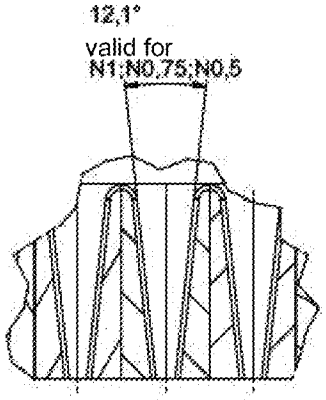
FIG. 4 is an enlargement of the detail D from FIG. 3, showing the nozzles.
Figure 5:
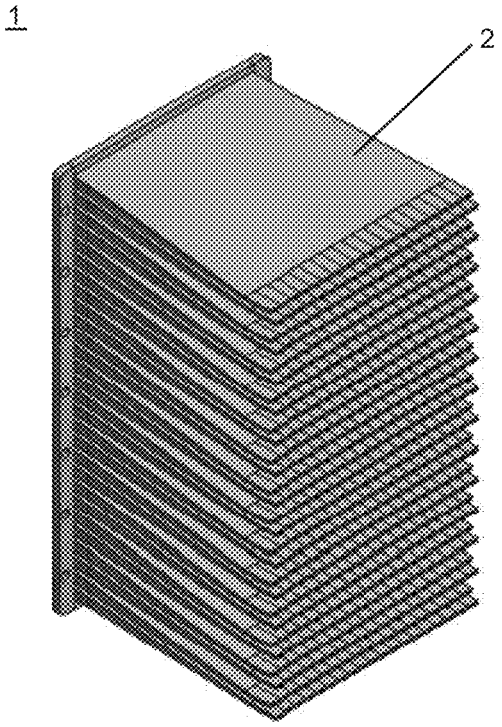
FIG. 5 is a schematic, perspective view of the arrangement of tempering blades.
Figure 6:
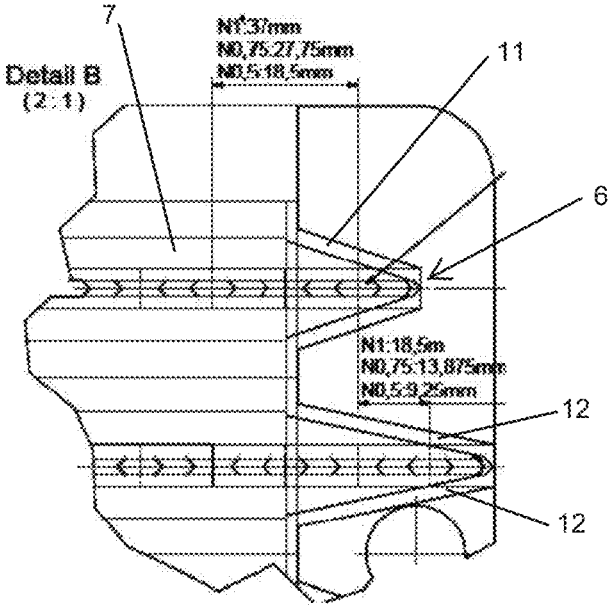
FIG. 6 is an enlarged detail of the edge region of the tempering blades, with an offset within the arrangement of blades.
Figure 7:
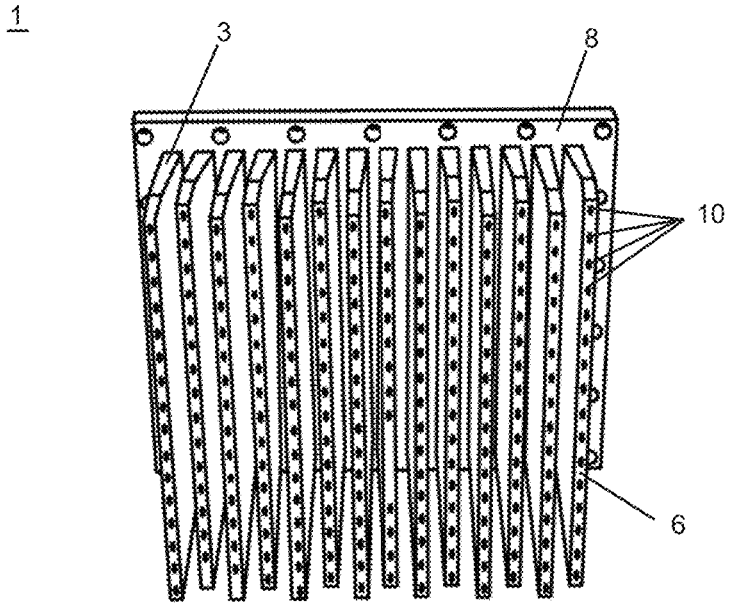
FIG. 7 is a perspective view of an arrangement of tempering blades according to the invention, which are consolidated into a tempering block.
Figure 8:
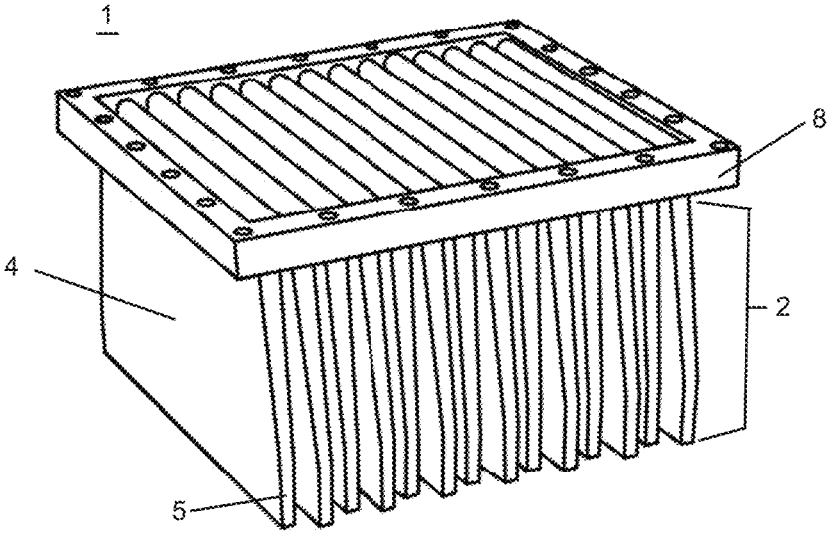
FIG. 8 is a perspective rear view of the arrangement according to FIG. 7.
Figure 9:
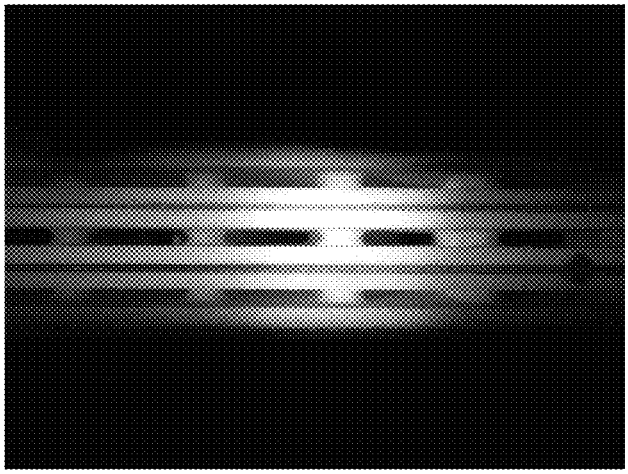
FIG. 9 is a view into the interior of tempering blades according to the invention.
Figure 10:
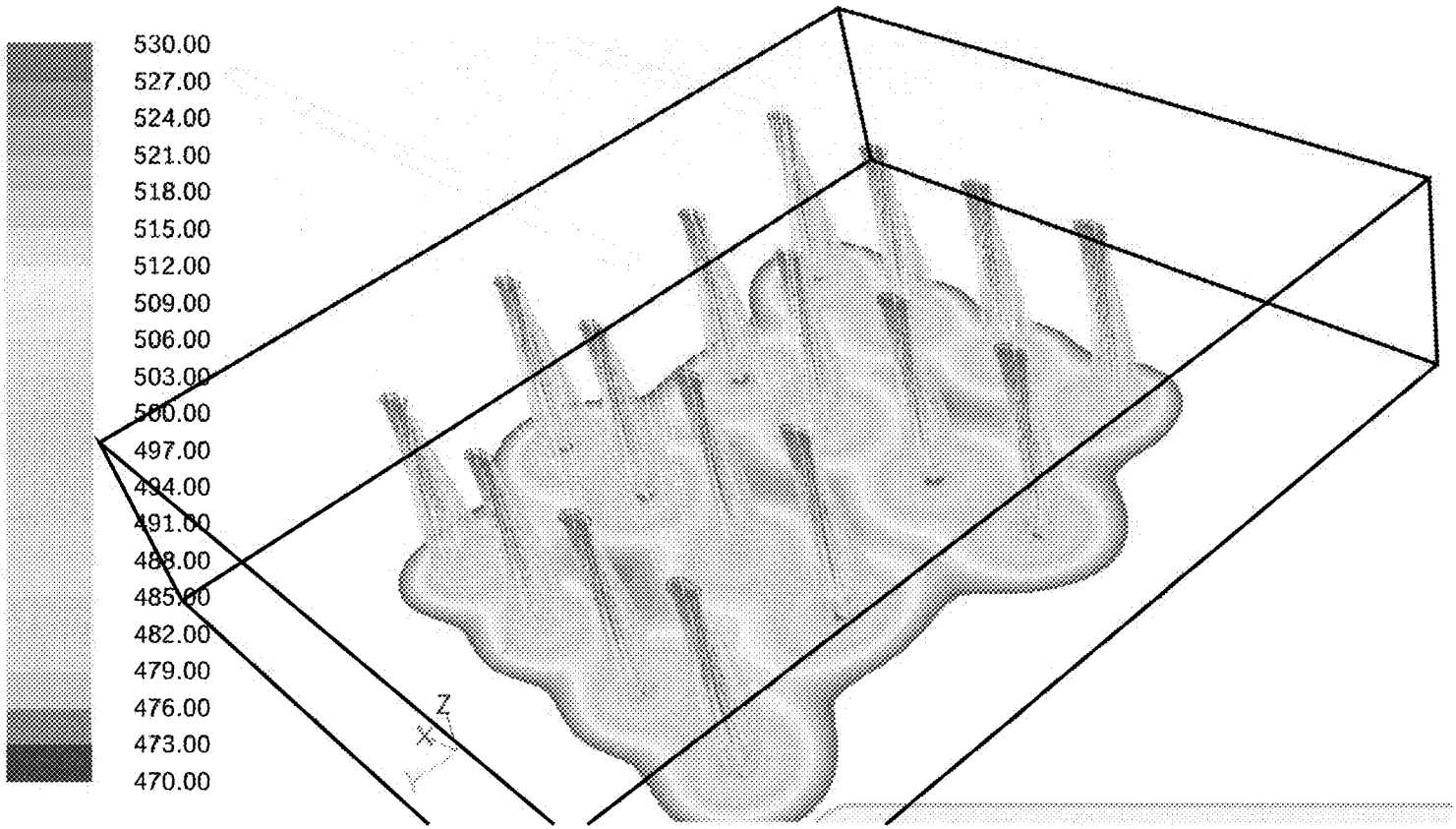
FIG. 10 depicts the tempering blades with the nozzles, showing a plate to be tempered, the temperature distribution, and the fluid temperature distribution.

Through a relative movement either of the tempering apparatus in relation to a body to be tempered or vice versa, the tempering pattern according to FIG. 10 moves across the surface of the body to be tempered; the medium flowing away from the hot body finds enough room between the tempering blades 2 and thus no cross flow is produced on the surface to be tempered.

According to the invention, the spaces between are acted on with corresponding flow mediums by means of an additional cross flow in order for the medium flowing against the body to be tempered to be sucked up between the blades.

With the invention, it is advantageously possible to achieve a homogeneous tempering of elements to be tempered that is inexpensive and has a high degree of variability with regard to the target temperature and possible throughput times.

REFERENCE NUMERALS

1 tempering apparatus
2 tempering blade
3 tempering blade base
4 tempering blade broad sides
5 tempering blade narrow sides
6 nozzle edge
7 cavity
8 tempering blade frame
10 nozzles
11 nozzle conduits
12 wedge-shaped struts
14 fluid supplies

The invention claimed is:

1. A tempering apparatus for tempering articles that are to be tempered, the tempering apparatus comprising:

a tempering blade frame (8);

at least seven tempering blades (2) disposed in the tempering blade frame (8); and a fluid supply box (15) in operable communication with the at least seven tempering blades (2), wherein each tempering blade (2) is hollow and has a tempering blade nozzle edge (6) comprising at least one nozzle (10) configured to be aimed at an article to be tempered, wherein the at least seven tempering blades are arranged in such a way that a honeycomb-shaped flow pattern is formed on a surface of the article to be tempered, wherein a moving device (16) is provided, with which the at least seven tempering blades (2) can be moved with the tempering blade frame (8) and the fluid supply box (15), with which the article to be tempered can be moved relative to the at least seven tempering blades (2) so that a swinging or oscillating movement relative to each other can be produced, and wherein the tempering apparatus is equipped with units such that the tempering blade frame (8) with the at least seven tempering blades (2) disposed therein is configured to swing or oscillate around all three of the X axis, the Y axis, and the Z axis simultaneously.

2. The tempering apparatus according to claim 1, wherein the at least seven tempering blades (2) are arranged parallel to and spaced apart from one another.

3. The tempering apparatus according to claim 1, wherein the at least seven tempering blades (2) are respectively offset from one another by half a distance between the nozzles (10) at the nozzle edge (6).

4. The tempering apparatus according to claim 1, wherein each tempering blade (2) further comprises a tempering blade base (3), tempering blade broad sides (4), and tempering blade narrow sides (5), wherein in each tempering blade (2), the nozzle edge (6), the tempering blade broad sides (4), and the tempering blade narrow sides (5) border a cavity (7), wherein the tempering blade base (3) of each tempering blade (2) is disposed in or on the tempering blade frame (8), and wherein the tempering blade frame (8) is disposed on the fluid box (15).

5. The tempering apparatus according to claim 1, wherein the following conditions are present:

hydraulic diameter of nozzle=DH, where DH=4×A/U distance of nozzle from article=H distance between two tempering blades=S length of nozzle=L

L>=6×DH

H<=6×DH, esp. 4 to 6×DH

S<=6×DH, esp. 4 to 6×DH oscillation=half of the spacing distance between two tempering blades in X axis direction and Y axis direction.

6. The tempering apparatus according to claim 1, wherein the tempering blade frame (8) with the at least seven tempering blades (2) disposed therein is configured to swing or oscillate around all three of the X axis, the Y axis, and the Z axis simultaneously at an oscillation speed of 0.25 seconds per cycle.

7. A method for tempering articles that are to be tempered, the method comprising:

providing the tempering apparatus according to claim 1, the at least seven tempering blades (2) being arranged parallel to and spaced apart from one another;

providing an article with a hot surface to be tempered;

moving the tempering apparatus and the article with the hot surface relative to each other;

aiming the nozzles (10) of the at least seven tempering blades (2) at the article with the hot surface to be tempered; and directing, by the nozzles (10), a tempering fluid at the hot surface of the article to be tempered such that after contacting the hot surface, the tempering fluid flows away in spaces between the tempering blades (2), wherein during the directing of the tempering fluid at the hot surface of the article to be tempered, the tempering blade frame (8) with the at least seven tempering blades (2) disposed therein swings or oscillates around all three of the X axis, the Y axis, and the Z axis simultaneously.

8. The tempering apparatus according to claim 1, wherein the tempering apparatus is equipped with units such that the tempering blade frame (8) with the at least seven tempering blades (2) disposed therein is configured to swing and oscillate around the all three of the X axis, the Y axis, and the Z axis simultaneously.

9. The method according to claim 7, wherein during the directing of the tempering fluid at the hot surface of the article to be tempered, the tempering blade frame (8) with the at least seven tempering blades (2) disposed therein swings and oscillates around all three of the X axis, the Y axis, and the Z axis simultaneously.

* * * * *